US005129521A

United States Patent [19]

Irigoite et al.

[11] Patent Number: 5,129,521

[45] Date of Patent: Jul. 14, 1992

[54] DISPOSABLE HOLDER FOR PIZZA SLICE

[75] Inventors: Fabio Irigoite; Breno S. Mallmann, both of Porto Alegre, Brazil

[73] Assignee: GRUPOUTIL desenvolvimento de produtos de utilidada Ltda., Porto Alegre, Brazil

[21] Appl. No.: 621,349

[22] Filed: Dec. 3, 1990

[30] Foreign Application Priority Data

Dec. 7, 1989 [BR] Brazil ..... MU 6902561[U]

[51] Int. Cl.[5] ..... A45C 11/20

[52] U.S. Cl. ..... 206/551; 206/565; 229/DIG. 13

[58] Field of Search ..... 206/551, 525, 565; 229/DIG. 13, 906, 902, 115, 116

[56] References Cited

U.S. PATENT DOCUMENTS

| | | | |
|---|---|---|---|
| 2,333,943 | 11/1943 | Levkoff | 229/87.11 |
| 2,367,675 | 1/1945 | Greenleaf, II | 229/35 |
| 2,584,379 | 2/1952 | Chmielewski | 206/4 |
| 3,355,082 | 11/1967 | Wood | 229/16 |
| 3,446,416 | 5/1969 | Epstein | 229/31 |
| 3,937,389 | 2/1976 | Wind | 229/2.5 R |
| 4,635,843 | 1/1987 | Tomlinson | 229/52 B |
| 4,836,593 | 6/1989 | Cooley | 294/1.1 |
| 4,940,190 | 7/1990 | Groves | 229/122 |

FOREIGN PATENT DOCUMENTS 6900534 9/1989 Brazil .

*Primary Examiner*—Paul T. Sewell
*Assistant Examiner*—Thomas P. Hilliard
*Attorney, Agent, or Firm*—Bachman & LaPointe

[57] ABSTRACT

A disposable pizza slice holder, of the kind used for supporting a slice of pizza for fast eating, is formed by an approximately triangular flat base body whose shorter side has a hinging flap section of trapezoidal shape provided with a lobbed section protrudring from the central portion of its free edge. In an alternative embodiment, the rear flap section is provided with an extension wall which is hinged by means of parallel folding lines, to the base body and to the flap portion, so as to shape-up a rear lodging side, through the flipping of the upper flap toward the base body having a back vertical wall whose height is determined by the width of the extension wall, to back up and encase the enlarged rim of the supported pizza slice, and there are two lateral ear sections protruding from laterally hinged walls having a triangular shape, the ear sections having a profiled inner edge to allow the upper section to slide into two parallel receiving slots, provided along the lower extension wall of the hinged flap section.

5 Claims, 5 Drawing Sheets

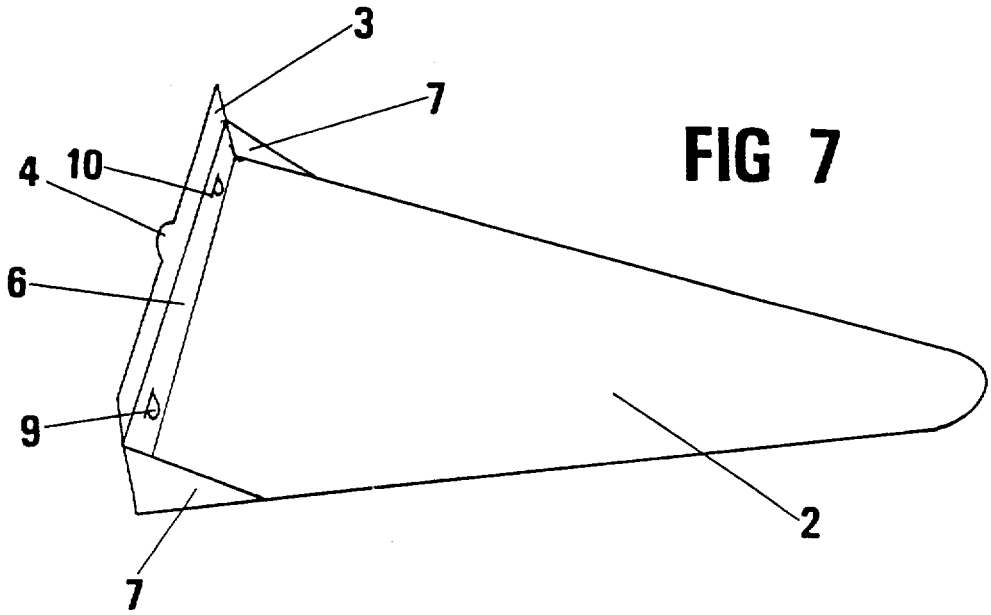
FIG 7
FIG 8
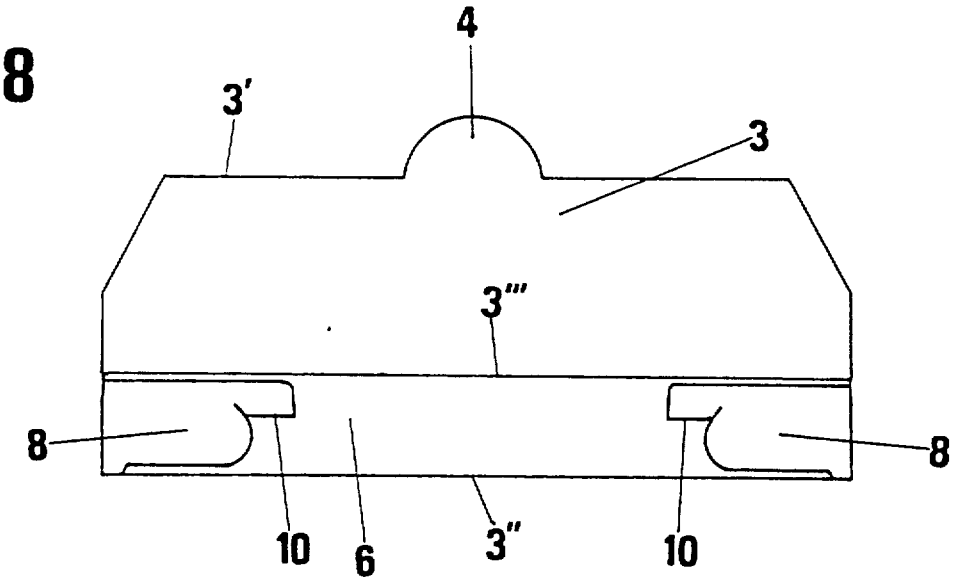

DISPOSABLE HOLDER FOR PIZZA SLICE

BACKGROUND OF THE INVENTION

This patent application refers to a disposable pizza holder to be used when eating a slice of pizza, which is designed to hold a slice of pizza in such a way that the user's hand does not touch the pizza slice that is being eaten, while he may exert an easy grip thereon to prevent its sliding off.

It is know as prior art the brazilian patent application BR-MU 6900534, filed on Apr. 6, 1989, published Sep. 26, 1989, which discloses a pizza holder having a main approximately triangular body, made of flexible material, two symmetric lateral flaps and a rear wall.

As can be seen from FIGS. 1 and 2 enclosed hereto, which are respectively a view from above of the holder showing the prior art in a disassembled view, and the rear view of the same pizza support duly assembled and ready to use, where the dotted lines A show the folds to be made for assemblage of said holder, the lateral flaps B are formed by folding of the base itself C, and the rear wall D is formed by the adjustment of the two extensions E on the rear part of the holder.

To hold a slice of pizza placed on the triangular base, the user will secure it in position by pressure exerted by the user's hand over the lateral flaps of the holder, so that a clipping action will be exerted on the borders of the pizza slice, and displacing the portion of the frontal triangular base toward the rear flap for exposure of the pizza slice.

The said known kind of support is not very efficient because of the fact that in order to retain the pizza slice on the holder, the user is required to firmly press its lateral flaps with his fingers, which may become uncomfortable in case the user is holding a large slice of pizza, thus requiring the user to exert a continuous lateral pressure.

BRIEF DESCRIPTION OF THE INVENTION

It is the object of the invention to provide a holder for pizza slice of the kind that is capable of overcoming the inconveniences of the prior art, specifically providing a holder which is easy to be used and which does prevent any direct contact of the user's fingers with the slice of pizza which is being eaten.

To this end, the holder of this invention is formed by an approximately triangular flat base body whose shorter side has a hinging flap section of trapezoidal shape provided with a lobbed section protruding from the central portion of its free edge, being the said base and the rear flap and lobbed section made of flexible and disposable material, as for example, paper sheet with a cellophane coating, or a paper sheet with a polymeric material coating, or in any way, a flexible material having an impermeable working surface.

In an alternative embodiment of this invention the said rear flap section is provided with an extension wall which is hinged by means of parallel folding lines, to the base body and to the flap portion, so as to shape-up a rear lodging side, through the flipping of the upper flap toward the said base body having a back vertical wall whose height is determined by the width of the said extension wall, to back up and encase the enlarged rim of the supported pizza slice.

To prevent the said flipping rear flap section of the pizza holder from loosening the grip on the pizza rim during the use of the holder, there are two lateral ear sections protruding from laterally hinged walls having a triangular shape, the said ear sections having a profiled inner edge to allow its upper section to slide into two parallel receiving slots, provided along the said lower extension wall of the hinged flap section.

DETAILED DESCRIPTION OF THE DRAWINGS

The invention will be better disclosed in the light of the accompanying drawings, in which:

FIG. 7 is a perspective view of the holder of FIG. 6; and

FIG. 8 is a rear elevational view of the holder of FIG. 6.

DESCRIPTION OF THE PREFERRED EMBODIMENTS

Figure 1:
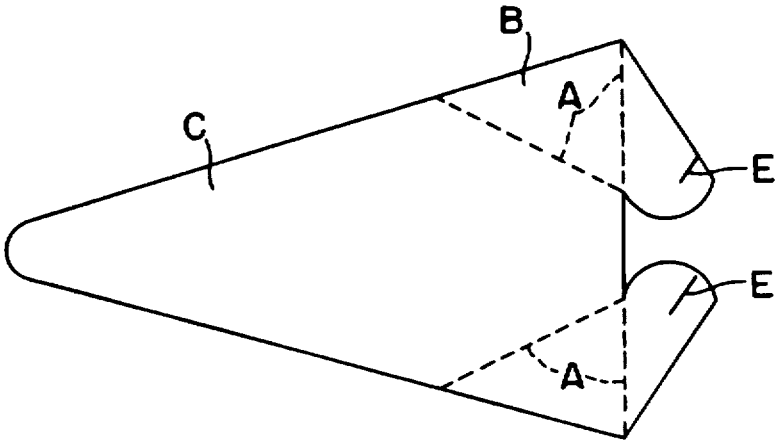
FIG. 1 PRIOR ART
FIG. 1 is a top view of the prior art holder, in the unfolded condition.
Figure 2:
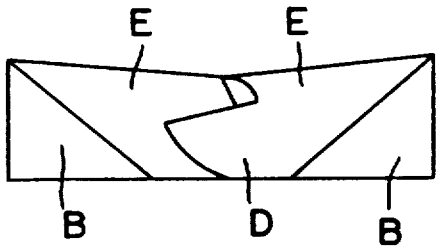
FIG. 2 PRIOR ART
FIG. 2 is a rear view of the holder of FIG. 1, in the assembled shape.
Figure 3:
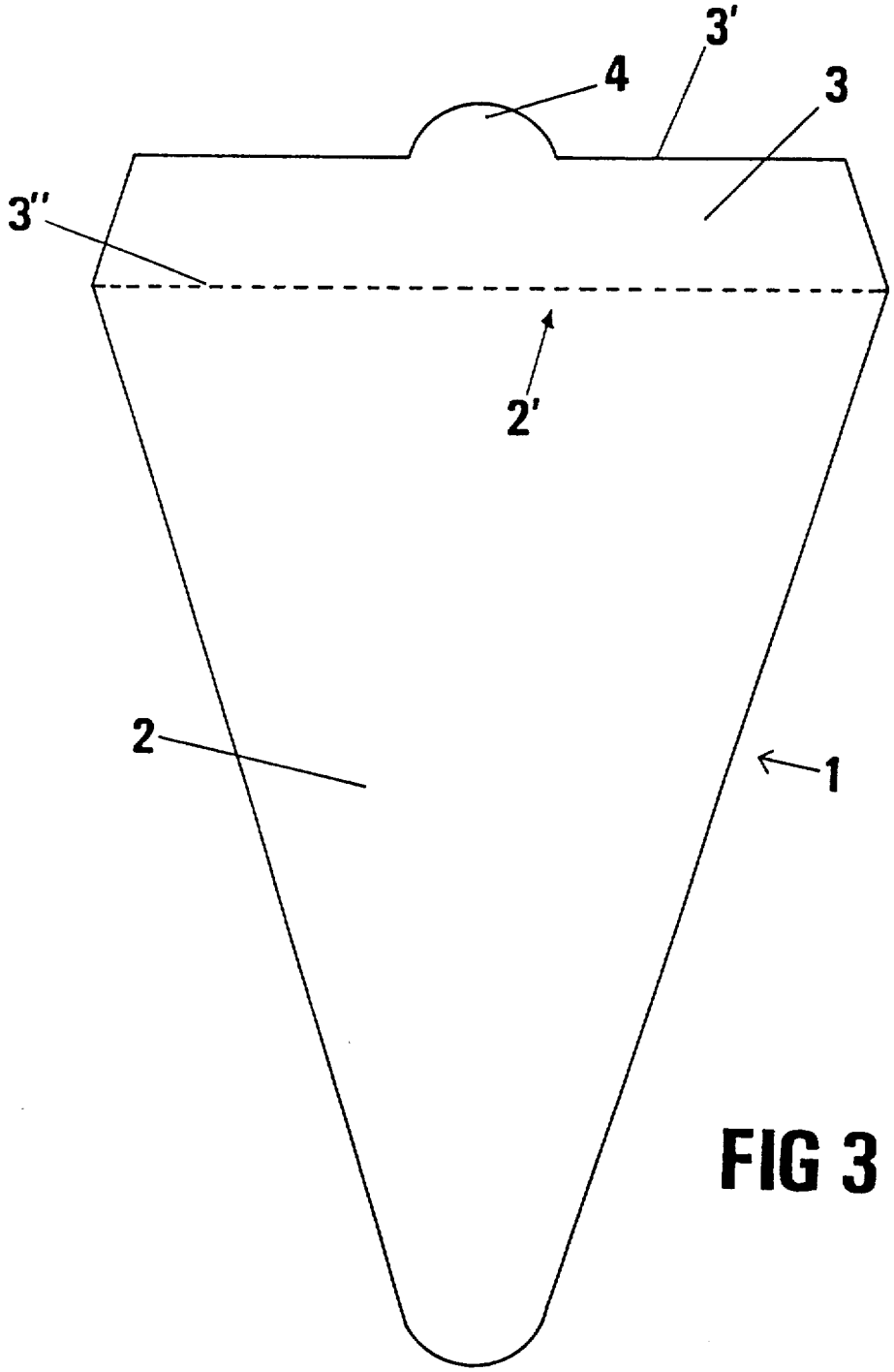
FIG. 3 is a top view of the holder of this invention with the hinging flap section in the extended unfolded position.

According to FIG. 3 of the drawings, the pizza holder 1 has an approximately triangular flat base body 2, whose shorter side 2' is provided with a flap hingable portion 3 having a lobed section 4 protruding from free edge 3' thereof.

Figure 4:
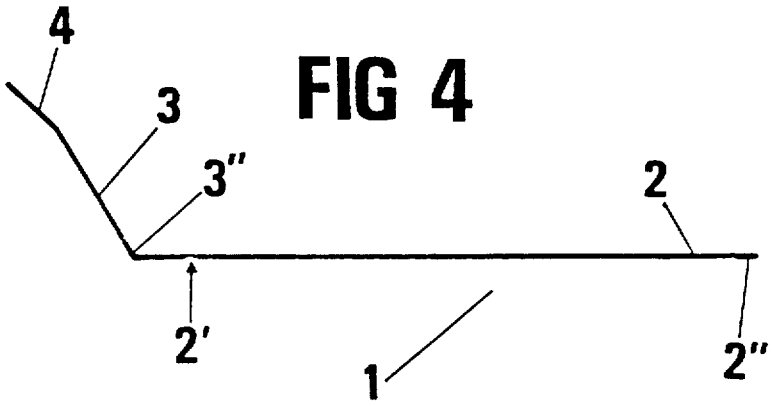
FIG. 4 is a side view of the holder of FIG. 3.
Figure 5:
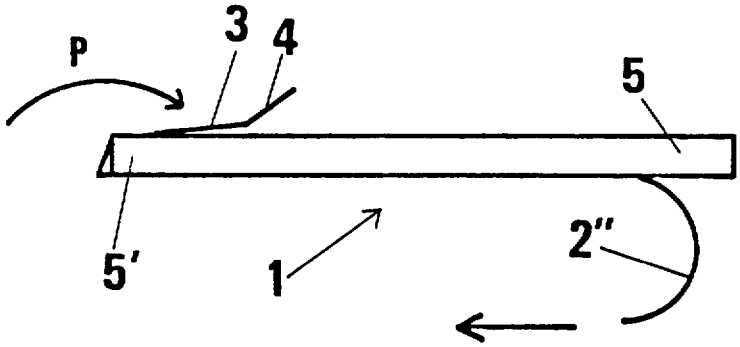
FIG. 5 is a side view of the holder supporting a pizza slice.

The said flap 3 may be hinged over the flat base 2 along the folding line 3" as shown in FIGS. 4 and 5 so as to trap the rim 5 of the pizza slice 5 and to hold it firmly by a slight pressure P exerted from the top of the flap portion 3 by the user's fingers of one hand while, with the other hand, he may easily turn the free front side 2" of the base body 2 downward, thus progressively exposing the pizza slice free portion to be eaten.

Figure 6:
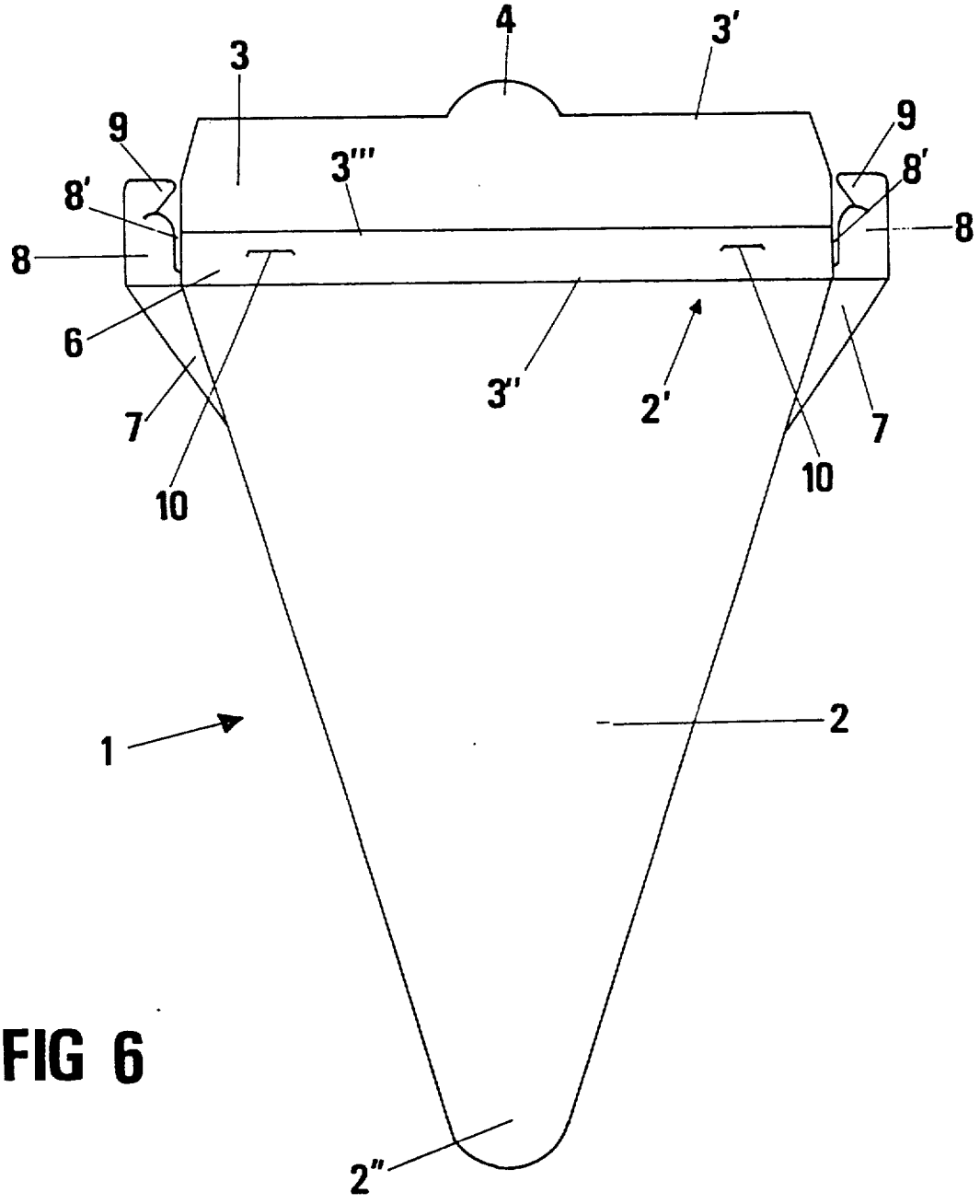
FIG. 6 is a top view of the alternate embodiment of the invention.

FIGS. 6, 7 and 8 show an alternative embodiment of the holder 1 by which the rear hinging flap portion 3 is provided with an extension intermediate wall 6 which is hinged to the base body 2 through the folding line 3" and to the tilting portion of the flap 3, along to the folding line 3'.

The said intermediate wall extension 6 does provide a wall onto which the pizza slice rim 5' will back up while the combination of the said wall with the tiltable upper flap portion 3 and with the lateral ears 7, 8 will provide an encasing to improve the holding action resulting of the pressure externally exerted by the user.

The said lateral walls 7 are also provided with flipping fastening means 8 as shown in FIGS. 6 to 8, whose inner side is outlined with a curved path 8' and a lobbed end 9 to allow insertion of the lobbed end into the straight slots 10 provided along the said intermediate extension wall 6 after their right-angled tilting over the outer side of the said intermediate wall 6 after assembling the flap portion 3 as show in FIG. 8.

What we claim is:

1. A holder for pizza slices of the kind used for supporting a slice of pizza which comprises: an approximately triangular flat base body having a shorter side; a hinging flap section of trapezoidal shape affixed to the shorter side along a folding line and having a free edge opposed to said folding line, said free edge having a central portion thereof; and a lobed section protruding from the central portion of said free edge whereas the free edge has no other holder structure attached thereto except for the lobed section; wherein the base has a shape substantially corresponding to the shape of a generally triangular pizza slice and wherein the holder has a back vertical wall upon folding the hinging flap section along the folding line whereby the lobed section is positioned over the base and is operative to grip a pizza slice, wherein said holder is provided with an extension wall having spaced parallel folding lines, one of which is hinged to the base body shorter side and the other of which is hinged to the flap section, so as to form a rear lodging side upon folding the flap section along said folding lines towards the said base body, wherein said holder has a back vertical wall whose height is determined by the distance between the parallel folding lines of the extension wall, said holder being operative to back up and encase an enlarged rim of a supported pizza slice.

2. A holder according to claim 1 wherein said extension wall includes two parallel, spaced apart receiving slots therein, said holder including: lateral hinged walls protruding from said body and having a generally triangular shape; and two lateral ear sections protruding from said lateral hinged walls, said ear sections having upper sections thereof and having a profiled inner edge to allow their upper sections to slide into said parallel receiving slots.

3. A holder according to claim 1 made of flexible and disposable material comprising a paper base having a coating on the surface thereof.

4. A holder according to claim 3 wherein said paper base is covered with a cellophane coating.

5. A holder according to claim 3 wherein said paper base is covered with a polymeric coating.

* * * * *